United States Patent [19]

Steiling

[11] 4,263,947

[45] Apr. 28, 1981

[54] MACHINE FOR PROFILING WOOD PANEL TO SIMULATE LAP SIDING

[76] Inventor: Virgil Steiling, 8505 43 W., Tacoma, Wash. 98466

[21] Appl. No.: 1,020

[22] Filed: Jan. 5, 1979

[51] Int. Cl.[3] ..... B27C 5/00

[52] U.S. Cl. ..... 144/2 R; 144/134 A; 144/323; 144/49; 409/228; 409/229

[58] Field of Search ..... 264/119; 409/228, 229; 144/1 R, 2 R, 3 R, 114 R, 116, 120, 117 R, 117 A, 117 B, 134 R, 134 A, 136 R, 323, 326 R, 49

[56] References Cited

U.S. PATENT DOCUMENTS

| | | | |
|---|---|---|---|
| 2,722,957 | 11/1955 | Marvosh | 144/3 R X |
| 3,602,276 | 8/1971 | Kvalheim | 144/3 R X |
| 3,625,269 | 12/1971 | Holan | 144/136 R |
| 3,703,198 | 11/1972 | Luebs et al. | 144/7 R |
| 3,756,295 | 9/1973 | Halop | 144/323 X |

*Primary Examiner*—W. Donald Bray

[57] ABSTRACT

This machine cuts and profiles large panels, as plywood, hardboard or similar materials, on one side to provide a large panel having a flat back surface and a profiled front surface, said front surface characterized by a plurality of longitudinally extending, side by side, slightly inclined flat surfaces separated by approximately perpendicular ledges or shoulders of narrow width, thereby imparting to the panel the appearance of lap siding when applied to the exterior wall of a building. This machine comprises devices for moving the panel in a lengthwise direction and across a plurality of driven planer heads or routers, which cut away thin layers of the front panel surface. Also, the machine is provided with devices for shaping the edges of each panel for edge matching these edges with interfitting parts which may be of shiplap or tongue-and-groove type.

2 Claims, 9 Drawing Figures

MACHINE FOR PROFILING WOOD PANEL TO SIMULATE LAP SIDING

BACKGROUND OF THE INVENTION

Prior art machines produced lumber boards, usually about 6" wide, of lengths the lumber stock would permit, and with one edge thick and the other thin. These boards were installed horizontally on the side of a building with the thicker, lower edge of each board overlapping the thin upper edge of the next adjacent panel below it. The aesthetic effect of an outside wall so constructed was to cast shadows and break up the plane, flat appearance of a wall made from materials having a common depth dimension.

The only prior art known to applicant having any pertinency is:

| U.S. PAT. NOS. | | |
|---|---|---|
| 2,281,500 | Jaeger | April 28, 1942 |
| 3,826,054 | Culpepper, Jr. | July 30, 1974 |
| 2,099,131 | Miller | Nov. 16, 1937 |
| 3,515,620 | McPherson | June 2, 1970 |
| 3,899,855 | Gadsby | Aug. 19, 1975 |
| 3,760,546 | Martin et al | Sept 25, 1973 |
| 2,427,879 | Robertson et al | Sept 23, 1947 |
| 2,835,622 | Clark | May 20, 1958 |
| 2,718,674 | Hinds | Sept 25, 1955 |
| | FRENCH | |
| 1,198,758 | Robin | Délivré le 15juin 1959 |

SUMMARY OF THE INVENTION

An object of this invention is to provide a machine for cutting the outer surface of large panels, such as plywood, hardboard, particle board, fiber board, or the like, with wood working tools to profile the outer face of such a board with longitudinally extending side by side, flat, slightly inclined surfaces separated at their adjoining edge by narrow, approximately perpendicular shoulders or ledges so that when a plurality of such panels are applied to the exterior of a wall, the completed wall will have an appearance simulating a wall having lap siding thereon.

Another object is to provide a machine profiling a panel simulating lap siding and which panels save material and lessen the number of joints over prior art siding lumber by eliminating overlaps and by lessening the number of pieces employed.

Another object is to provide such panels so that the cost and time required for installation thereof are substantially lower than those of installing lap siding. Also, the matched ends of the panels cooperate in providing a tighter wall than one formed by lap siding lumber.

Another object is to provide novel and efficient machines of planar and router type for profiling flat surfaces of large panels of plywood, hardboard and like material to simulate the appearance of lap siding and further, as part of the same operation, are capable of shaping the lateral edges of the panels so they will match or interfit when the panels are applied to a wall.

Another object is to provide efficient mechanism for shaping and texturizing the surfaces of large size plywood panels to impart to them the appearance of lap siding and to further give them the appearance of rustic or rough cut wood.

Other objects will be apparent from the following description and accompanying drawings.

BRIEF DESCRIPTION OF THE DRAWINGS

Like reference numerals refer to like parts throughout the drawings.

DESCRIPTION OF PREFERRED EMBODIMENTS

Figure 1:
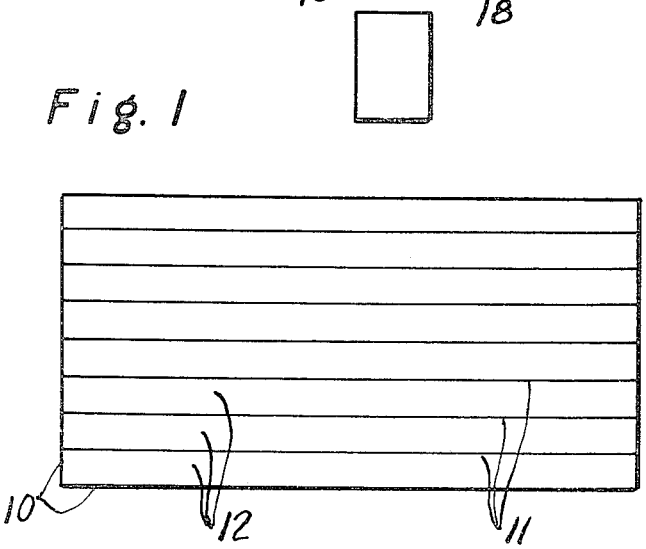
FIG. 1 is a view in elevation showing the outer side of a panel which has been shaped in accordance with this invention to simulate lap siding.
Figure 3:
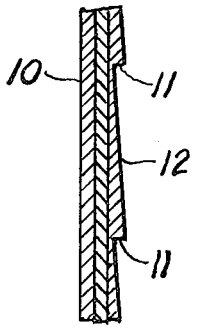
FIG. 3 is a fragmentary cross sectional view, on a larger scale than FIGS. 1 and 2, of the same.
Figure 2:
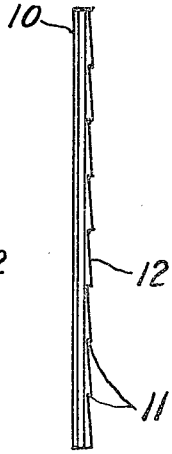
FIG. 2 is an end view of the same.

FIGS. 1 to 3 show a panel 10, of a type commonly used in building construction. Such panels usually are of fairly large size, such as four by eight feet, but this size varies widely. They can be plywood, hardboard or other like material used in building construction and suitable for being worked on with wood working tools.

In accordance with this invention, panels 10 are profiled on one flat side by planing or routing away a plurality of longitudinally extending, side by side layers, which are thin and of triangular or tapered cross sectional shape, of the material which forms the surface of the panel. This leaves a profile surface made up of a plurality of longitudinally extending, side by side, slightly inclined strips 12 of boardlike appearance offset along their adjacent edges by shallow, substantially perpendicular shoulders or ledges 11. Preferably, the lateral edges of the panels are suitably shaped so they will match, for instance in shiplap fashion, FIG. 8, or in tongue-and-groove fashion, FIG. 9, when the panels are used in surfacing a wall.

Figure 4:
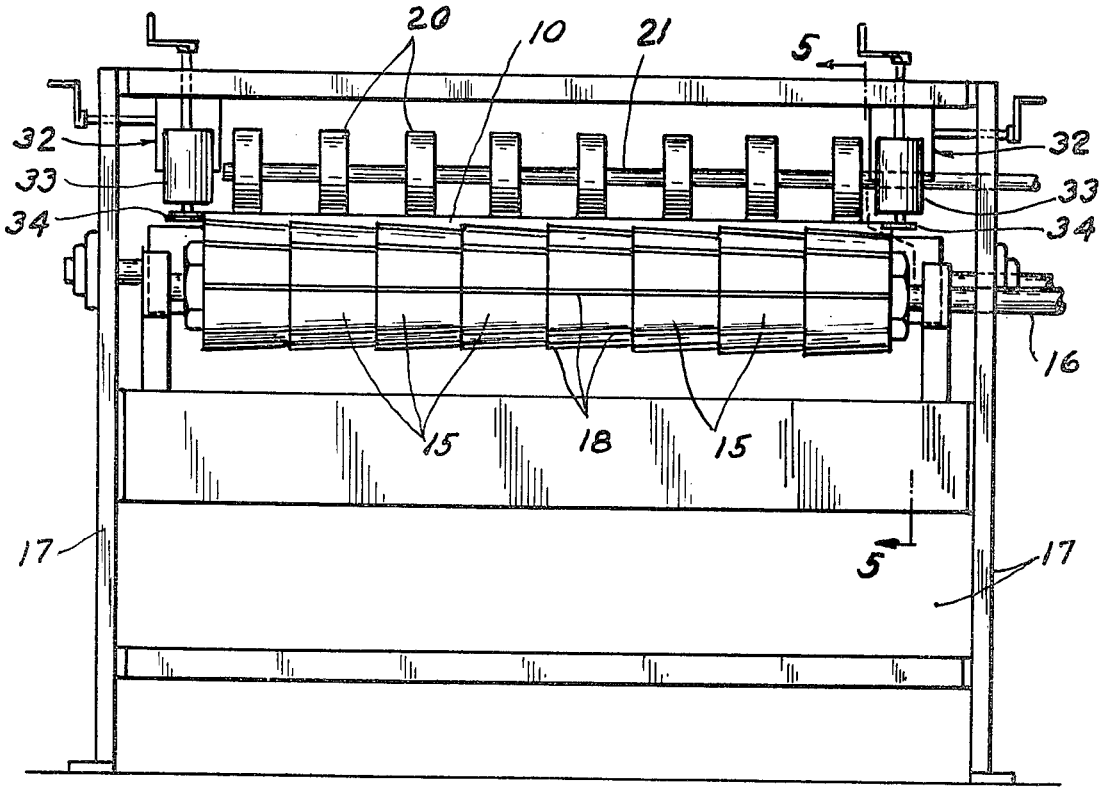
FIG. 4 is a somewhat diagrammatic end view showing a machine constructed in accordance with this invention in which planer type tools are used for shaping the surface of a large flat panel to simulate the appearance of lap siding.
Figure 5:
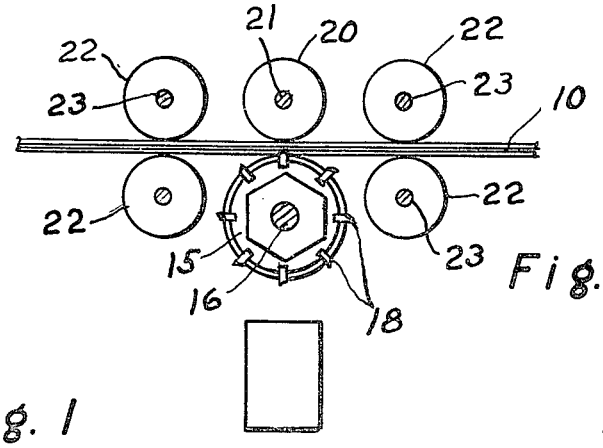
FIG. 5 is a fragmentary view in elevation looking in the direction indicated by line 5—5 of FIG. 4.

The planer type machine, shown in FIGS. 4 and 5, for shaping or profiling surfaces of panels 10, as just hereinbefore described, comprises a plurality of end to end, abutting planer heads 15, each rigidly secured on a driven shaft or arbor 16 which is rotatively supported by a frame 17. The planer heads 15 are provided with the usual knives 18 which extend from end to end of the planer heads and have straight cutting edges and are positioned so that when the arbor 16 is rotated, the cutting edges of the knives of each head 15 will move in a path which is slightly conical. Suitable panel hold-down and feeding means is provided for supporting panels 10 and feeding them longitudinally through the machine and over the driven planer heads 15 with the panels positioned so their lowermost sides will be properly presented to the planer heads 15 for profiling. The panel hold-down means comprises a plurality of hold-down rollers 20, each carried on a shaft 21, a fragment of which is shown in FIG. 4, and which is rotatively supported from the frame 17 and positioned parallel with and in spaced relation to and directly above the shaft or arbor 16 which carries the planer heads 15.

The panel feeding means comprises a plurality of pairs of driven feed rolls 22 supported on shafts 23 that are parallel with and transversely offset relative to the arbor 16. The two feed rolls off each pair are positioned one directly above the other and the shafts 23 which carry them are driven so that the adjacent peripheral parts of the two rolls 22 of each pair, move in the same direction and at the same speed. Preferably, several sets of feed rolls 22 are provided at each side of the planer heads 15.

Figure 8:
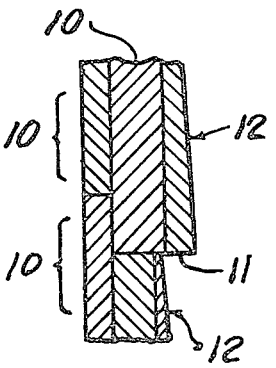
FIG. 8 is a fragmentary sectional view showing adjoining edge portions of two panels which are shaped to provide shiplap type edge matching.
Figure 9:
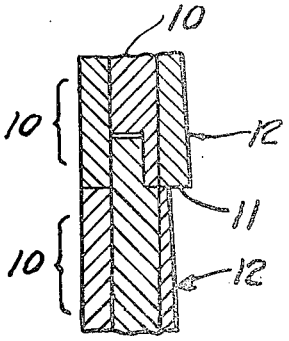
FIG. 9 is a view similar to FIG. 8 showing two panels having their edge portions shaped to provide tongue-and-groove type edge matching.

Two transversely opposite cutter head units 32, known in the woodworking art as side heads, are diagrammatically shown in FIG. 4 at opposite sides of the path of travel of the panels 10 through the machine. Each side head 32 comprises a motor 33 which carries and drives a matcher head 34. Each matcher head 34 has the usual knives for imparting a predetermined shape to the adjacent edge of a panel as it is moved past the matcher head. For instance, the two matcher heads may shape the respective edges of a panel 10 to provide for a shiplap type joint, as shown in FIG. 8 or a tongue-and-groove type joint, as shown in FIG. 9.

In operation, an end of each panel 10 is inserted between the first set of feed rolls 22 and the panel is fed by the rolls 22 in a longitudinal direction through the machine under the hold-down rolls 20 and across the driven planer heads 15 which impart to the lower side of each panel, the profile shown in FIGS. 1, 2, and 3. At the same time, the side heads 32 correctly shape the edges of the panel for matching purposes.

Figure 6:
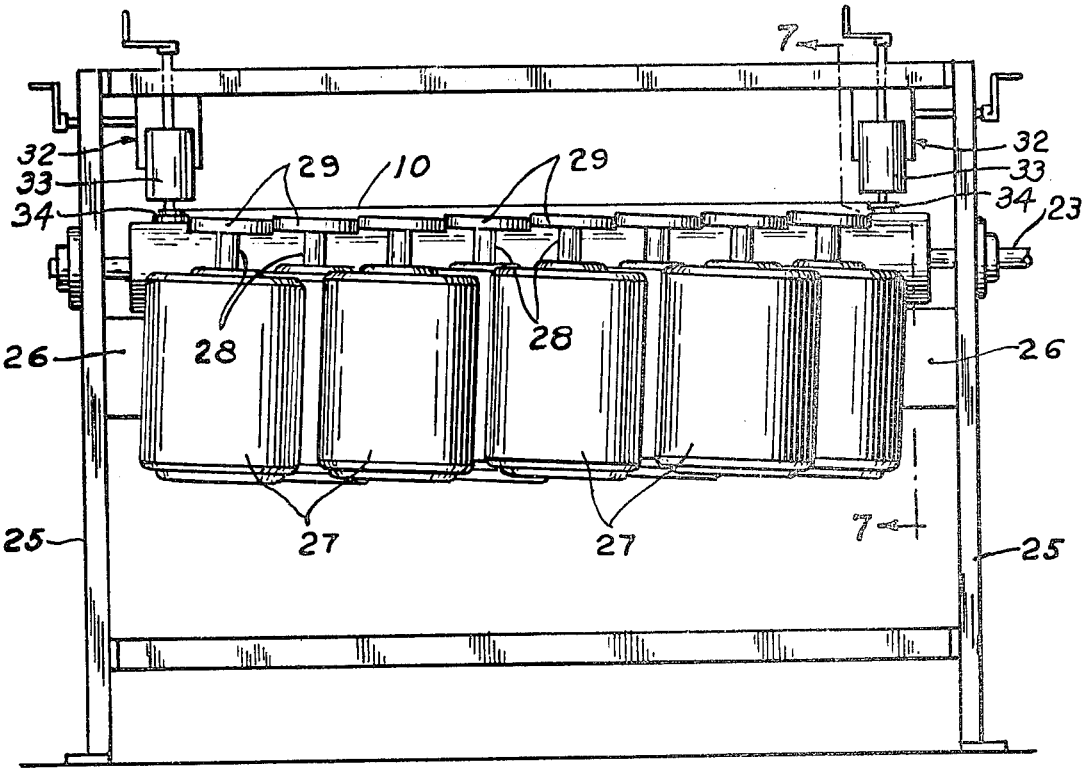
FIG. 6 is a somewhat diagrammatic end view showing a machine constructed in accordance with this invention in which router type tools are used for shaping a flat side of a large panel to simulate either smooth or roughly finished lap siding.
Figure 7:
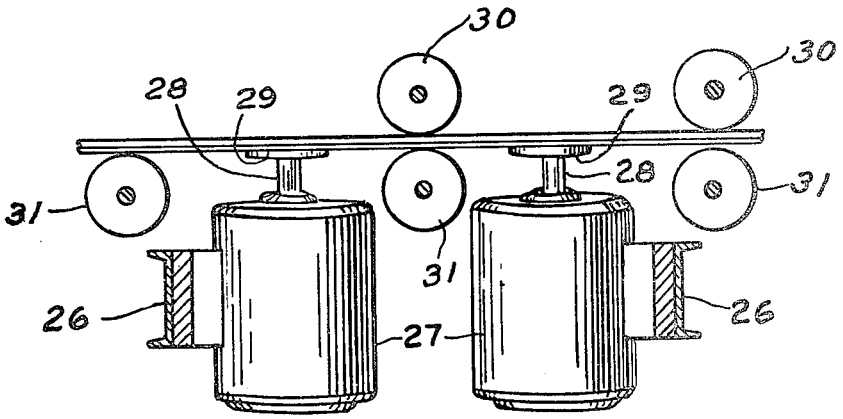
FIG. 7 is a fragmentary view in elevation looking in the direction indicated by line 7—7 of FIG. 6.

The router type machine for profiling surfaces of large panels to give them the appearance of lap siding, shown in FIGS. 6 and 7, comprises a main frame 25, cross frame members 26 supported by said main frame 25 intermediate its length, a plurality of routing tools supported from said cross frame members 26, each routing tool comprising a motor 27 having a generally upright driven shaft 28, carrying a rigidly attached, disc shaped, router head 29 on its upper end. For the purpose of this disclosure, I have shown and described each router head 29 as being attached directly to the shaft 28 of a motor 27 but it will be understood that each of said router shafts 28 may be provided with suitable bearings and driven from a different source of power. The driven shafts 28 are parallel to each other and at an acute angle to the vertical, such angle being determined by the desired incline of the strips 14 of the boardlike appearance offset, as shown in FIGS. 1, 2, and 3.

The routers are alternately offset relative to each other longitudinally of the main frame 25 and are evenly spaced apart transversely of said main frame. A plurality of upper driven feed rolls 30 and a plurality of lower driven feed rolls 31 are rotatively supported by and extend crosswise of the main frame 25. These feed rolls 30 are arranged in pairs with the upper feed roll directly above the lower feed roll of each pair and with their adjacent peripheral portions spaced far enough apart to receive and firmly grip and hold a panel 10 between them and they will move the panels longitudinally across the router heads. If desired, hold-down rollers, such as hold down rollers 20 of FIGS. 3 and 4, may be provided directly above each transverse row of router tools. Two side heads, similar in construction and mode of operation to the previously described side heads 32, are preferably provided in connection with the router type machine shown in FIG. 6.

The router heads are shaped to cut in planes perpendicular to the driven shafts 28 and each shaft 28 is inclined, in a sidewise direction from a line perpendicular to the plane of the panel surface to which the head is applied.

As the panels 10 move lengthwise in a straight line through the machine, each router head will remove a thin layer of panel face material of triangular cross section, from end to end of each panel and of a width equal to the diameter of the cutting part of the head and, in so doing, the group of routers will leave on the panel surface the plurality of longitudinally extending flat, slightly inclined surfaces 12 separated by the plurality of parallel longitudinally extending shallow shoulders on ledges 11. When routers are used for profiling the panel surface, the ledges 11 can be undercut and their offset appearance somewhat increased.

When plywood panels are being profiled in the router type machine, the cutting members of the router heads 29 will be cutting at varying angles, across and relative to the grain of the panels, and they will leave a rough surface and impart a rustic appearance to the panel surfaces 12.

The incline of the router heads relative to the plane of the panel face being worked on, causes the router heads to cut more deeply at one side than at the other and this imparts to the panel surface the appearance of lap siding.

The use of relatively large panels instead of relatively narrow boards as a surfacing for outside walls, makes possible a saving in the time and labor of installation and at the same time makes it possible to retain the desirable appearance provided by lap siding.

I claim:

1. In a machine for shaping flat surfaces of relatively large flat panels of material capable of being cut by woodworking tools, a frame; upper and lower driven feed rolls carried by said frame, positioned to receive therebetween relatively large, flat, rectangular panels, and move said panels longitudinally through the machine; power driven cutter means positioned in the path of travel of panels through the machine to cut material from the board and provide a profile on one surface thereof simulating a plurality of rows of lap siding, said power driven cutter means comprising a plurality of power driven rotary router heads, each having a cutter head mounted on a driven shaft, with the shafts mounted at acute angles to the vertical and coaxial with each other, and with the router heads supported by said frame transversely of the machine and adjacent one side of the path of travel of the panels and positioned for cutting engagement with a face of the panels, said router heads being positioned to cut in adjoining paths lengthwise of the panels and to cut in planes which, in a direction crosswise of the panels, are slightly inclined relative to the plane of the panel surfaces to which they are applied, whereby the panel surfaces are profiled to simulate the appearance of lap siding; and a plurality of coaxial, driven shafts, each rigid with a router head of said router heads.

2. The machine as claimed in claim 1 in which two edge matcher units are provided at the respective sides of the machine, each matcher unit including a driven matcher head positioned to operatively engage with and impart edge matching shapes to the edges of panels as the panels are moved past said matcher heads.

* * * * *